US005790687A

United States Patent [19]

McLaughlin et al.

[11] Patent Number: 5,790,687

[45] Date of Patent: Aug. 4, 1998

[54] METHOD AND APPARATUS FOR THE OPTICAL DETERMINATION OF THE ORIENTATION OF A GARMENT WORKPIECE

[75] Inventors: Richard S. McLaughlin, Tool; Jon McNeill, Farmersville, both of Tex.

[73] Assignee: Levi Strauss & Co., Del.

[21] Appl. No.: 664,436

[22] Filed: Jun. 18, 1996

[51] Int. Cl.[6] ..... G06K 9/00; G01N 21/00; D05B 21/00

[52] U.S. Cl. ..... 382/111; 382/108; 112/470.06; 356/239

[58] Field of Search ..... 112/121, 470.01, 112/470.02, 470.06, 470.03; 382/108, 111; 364/470; 356/238, 239, 429, 430, 431

[56] References Cited

U.S. PATENT DOCUMENTS

| | | | |
|---|---|---|---|
| 3,942,735 | 3/1976 | Marchio et al. | 242/56 |
| 4,602,577 | 7/1986 | Kothe et al. | 112/470.02 |
| 4,632,046 | 12/1986 | Barrett et al. | 112/121.14 |
| 4,638,749 | 1/1987 | Wood | 112/121.12 |
| 4,658,144 | 4/1987 | Croyle | 250/548 |
| 4,742,789 | 5/1988 | Pestel et al. | 112/262.3 |
| 4,786,177 | 11/1988 | Beckstein et al. | 356/429 |
| 4,795,913 | 1/1989 | Blessing et al. | 250/561 |
| 4,853,776 | 8/1989 | Itaya et al. | 358/106 |
| 4,890,924 | 1/1990 | Beckstein | 356/238 |
| 4,905,159 | 2/1990 | Loriot | 364/470 |
| 4,955,720 | 9/1990 | Blecha et al. | 356/429 |
| 5,027,416 | 6/1991 | Loriot | 382/8 |
| 5,033,399 | 7/1991 | Miyachi et al. | 112/142 |
| 5,197,012 | 3/1993 | El-Sarout | 364/470 |
| 5,237,181 | 8/1993 | Kerkhoff et al. | 356/429 |
| 5,269,257 | 12/1993 | Yamazaki | 112/262.2 |
| 5,315,367 | 5/1994 | Salvador et al. | 356/430 |
| 5,426,509 | 6/1995 | Peplinski | 356/430 |
| 5,452,079 | 9/1995 | Okugawa | 356/429 |
| 5,508,936 | 4/1996 | King et al. | 382/111 |
| 5,541,734 | 7/1996 | Nevel et al. | 356/429 |
| 5,642,198 | 6/1997 | Long | 356/430 |
| 5,657,710 | 8/1997 | Foster et al. | 112/470.06 |

*Primary Examiner*—Joseph Mancuso
*Assistant Examiner*—Jayanti K. Patel
*Attorney, Agent, or Firm*—Medlen & Carroll, LLP

[57] ABSTRACT

An improved method and apparatus for optical determination of the orientation of a garment workpiece by locating a seam on a stationary workpiece formed from at least two sub-pieces sewn together along that seam. The device consists of a light emitting surface on which the workpiece is placed, so that light is transmitted at a first intensity through the surface, at a second, lower intensity through a single layer of the fabric of the workpiece, and at a third, very low or no intensity through the seam, to provide a contrast in light intensities that highlight the shape of the workpiece and the location of the seam, which appears as a dark or black line. A CCD Vision System Camera can be mounted above the lighted surface to capture an image of the workpiece which is transmitted to a controller. The controller compares the image of the workpiece to a stored image of a like workpiece of known orientation, to determine the actual orientation of the workpiece. The computer can then, if desired, use an industrial robot or other similar device to reorient the workpiece to a desired orientation for further processing.

19 Claims, 3 Drawing Sheets

METHOD AND APPARATUS FOR THE OPTICAL DETERMINATION OF THE ORIENTATION OF A GARMENT WORKPIECE

FIELD OF THE INVENTION

The present invention relates to fabric inspecting methods and apparatus. More specifically, the present invention relates to an apparatus for locating a seam created between two fabric workpieces being joined together by sewing.

BACKGROUND OF THE INVENTION

As competition in the garment industry has increased, so has the need for producing quality garments in a cost effective manner. The most efficient manner of producing garments is through automating some, if not all, of the steps involved. In the process of automated garment production, it is often necessary to locate a landmark on the garment in order to accurately align two pieces for sewing or to perform further manufacturing processes. Most conventional methods involve photosensors which detect the edge of the garment workpiece, or the transmission of light through flaws in the fabric, or the reflection of light from the surface of the fabric, none of which aid in determining the orientation of a garment workpiece.

For example, U.S. Pat. No. 5,269,257 to Yamazaki discloses a method and apparatus for detecting thick portions of material in a workpiece by using a light transmission type thickness detecting sensor that detects when the level of transmitted light through the workpiece lessens. Yamazaki incorporates a point light source and light detector, which requires that overlapped portions pass between the light source and detector for the device to locate overlapping garments. Yamazaki's device cannot provide an accurate picture of the entire garment, but rather only the small portion passing between the light source and detector. Furthermore, the garment must be carefully aligned relative to the device for proper operation.

U.S. Pat. No. 4,853,776 to Itaya et al. discloses a fabric inspecting device that is capable of detecting flaws on both sides of a fabric. The fabric is transported along a conveyer between strobe devices and image pick-up elements which are located on both sides of the fabric. The strobe lights are arranged on each face of the fabric and emit light against the fabric while cameras on each face detect both light passing through the fabric and reflected from the fabric. A processing device analyzes the images to detect both holes in the fabric and lumps on both sides of the fabric. Although this device may be capable of detecting seams, it requires strobe lights, movement of the fabric, and information on both the reflection and transmission of light to operate.

U.S. Pat. No. 4,742,789 to Pestel et al. discloses a method and apparatus for self regulation of seam shapes. The invention includes detection heads and light emitters located in the area of a seaming point and connected to an information processing system. The detection head is located above the material and has a recording unit within. The detection head has a matrix of bores through which the light passes and strikes light conducting cables within each bore. The light cables then transfer the light to phototransistors. The light emitter may be located underneath the material when the material is translucent and, in that case, the edge of the material and the multiple layers of the material cause differences in the intensity of the light detected. The purpose of this invention is to accurately create a garment seam. For this result, the device manipulates the fabric being sewn by monitoring the light emissions from the emitters. In the case of translucent fabrics, the intensity of the detected light assists in manipulating the fabric. Unfortunately, this invention only allows for a small area to be examined at one time. Furthermore, the fabric must be moved across the emitter/detectors in order for proper operation.

U.S. Pat. No. 5,033,399 to El-Sarout discloses a light transmitter and optical detector positioned such that a fabric on a conveyor passes between the transmitter and detector. An object is conventionally sensed as the object passes between the transmitter and detector, breaking the beam of light from the transmitter. This invention while perhaps suitable for counting fabrics workpieces passing on the conveyer belt, is not useful for detecting seams or establishing the orientation of the workpiece. Furthermore, it requires that the fabric move between the transmitter and the detector.

U.S. Pat. No. 5,027,416 to Loriot discloses a method for locating the positions of templates used for cutting pieces from a sheet of material by means of markings on the template which are read by a charge coupled device (CCD) camera using reflected light. This invention requires that the fabric be opaque, such as leathers, which limit its application.

U.S. Pat. No. 4,905,159 to Loriot discloses a method of capturing dual images of a fabric having a repetitive design and processing the images in a computer programmed with information about a cutting template so that the best position for placing the templates on the fabric can be determined. Again, this invention suffers from the same limitations as the previously described U.S. patent to Loriot.

What is needed is an optical method and apparatus which will accurately determine the orientation of a garment workpiece in order to enable manipulation and alignment of the workpiece as necessary for further operations.

SUMMARY

The present invention provides for an improved method and apparatus for optical determination of the alignment of a garment workpiece by locating a seam on a stationary workpiece formed from at least two smaller workpieces sewn together along that seam. By locating the seam, and comparing it against a predetermined model, the system is able to determine how the garment is oriented such that subsequent manipulations of the workpiece can be made for further sewing procedures. The device consists of a light table, a CCD Vision System Camera mounted above the light table and a computer analyzer for analyzing the signals from the camera to determine the seam location. When the workpiece is placed on the light table, there is a visual difference between the unblocked portion of the light table, the single layer of fabric of the workpiece and the multiple layers of fabric across the seam. The camera will capture a portion of the light passing through the single layer, whereas the multiple layers at the seam will substantially block all of the light and the seam will appear as a black line. The camera subsequently transmits the image to the computer analyzer. If the computer analyzer is provided with data representative of the shape of the workpiece, it will be able, by locating the seam, to accurately determine the orientation of the workpiece, thus enabling subsequent accurate manipulation and alignment of the workpiece for sewing. This method requires no special registration or movement of the workpiece to determine its alignment and is capable of locating the orientation of the seam even when the workpiece is grossly misplaced on the light table.

DETAILED DESCRIPTION OF THE PREFERRED EMBODIMENT

While describing the invention and its embodiments, certain terminology will be utilized for the sake of clarity. It is intended that such terminology not limit the scope of the invention. Therefore, the invention includes all technical equivalents which perform substantially the same function, in substantially the same manner to achieve substantially the same result.

Figure 1:
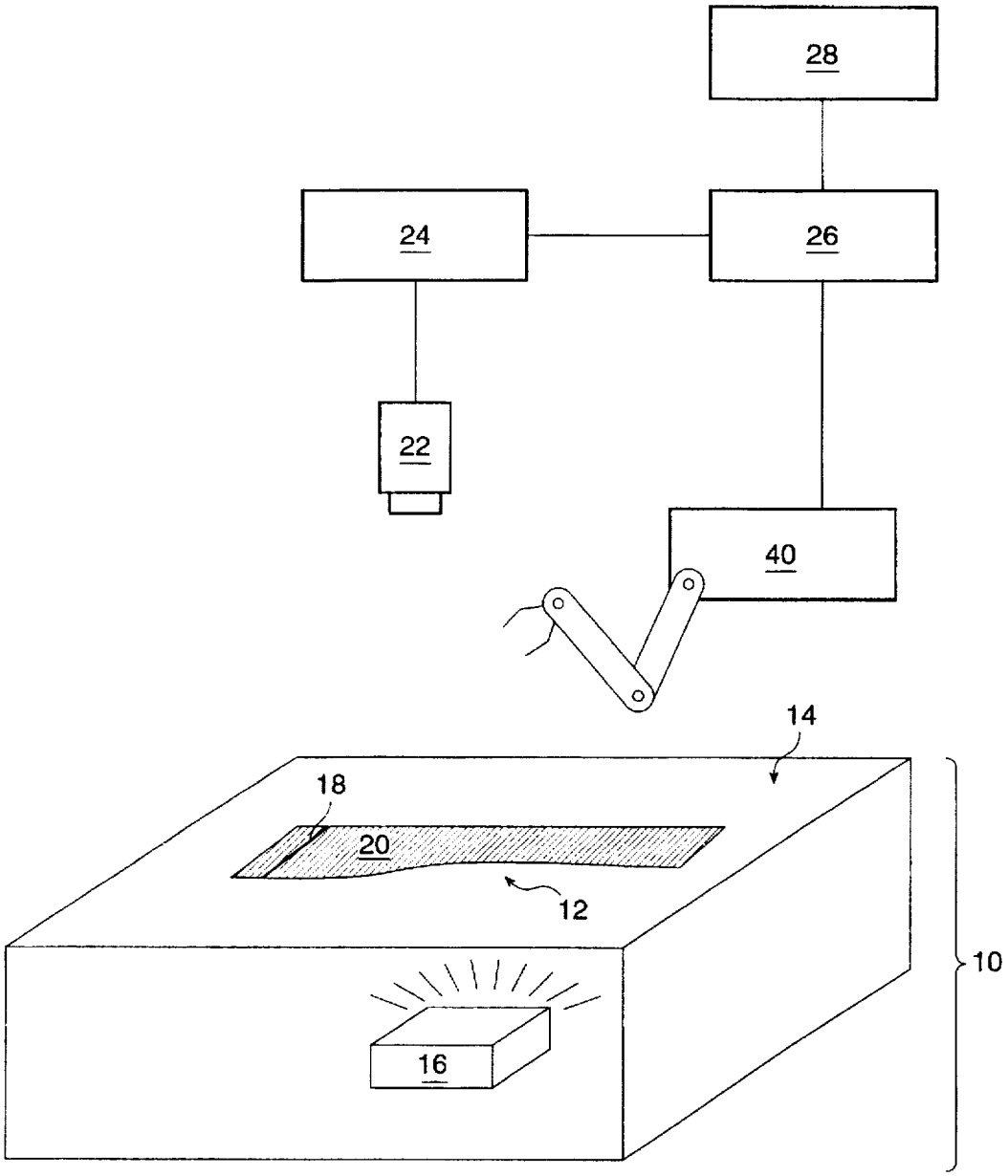
FIG. 1 illustrates a schematic representation of the preferred embodiment of the present invention.

FIG. 1 illustrates the basic design of the preferred embodiment of the present invention. A light table 10 is used to support and illuminate a workpiece 12. The surface of the light table 10 is comprised of a light transmitting material 14 which supports the workpiece 12. The surface 14 will workbest if formed from a transparent material such as a transparent plastic or glass plate, however, a translucent material can also be used. A light source 16 is located beneath the surface 14 and shines light through the surface 14 and against the underside of the workpiece 12. The light source 16 may take the form of any well known light source such as, but is not limited to, conventional light bulbs, fluorescent lights and halogen lights. Light source 16 must provide light of sufficient intensity, given the characteristics of the material used to construct the surface 14 and the fabric used to construct fabric workpiece 12, to illuminate substantially the entire surface 14 and penetrate, at a visually reduced intensity, a single ply of fabric making up the workpiece 12. In the preferred embodiment, the intensity is such that the surface of the light table around the workpiece 12 would have a first and brightest intensity, the portion of the workpiece which is a single ply of fabric would be illuminated to a second, lower intensity. The difference between the two intensities of light visually outlines the shape of the entire workpiece. Any overlapped portions of the fabric workpiece, such as a seam, are visually detectible as a third intensity of transmitted light which would be very low, wherein such areas appear visually as a dark or black stripe on the workpiece. To increase the usefulness of the light table for use with a wide variety of fabrics of varying thicknesses and translucency, it is desirable to provide a variable intensity control for light source 16 so that light intensity can be adjusted for maximum contrast between the light table 10, workpiece 12 and seam 18.

Although FIG. 1 illustrates the light table as merely having a surface 14 and a light source 16 beneath, it may have numerous different embodiments. For example, instead of the table configuration in FIG. 1, the light table may take the form of a box with a clear top to support the workpiece 12 and a light source within for illumination.

By using a light table 10 of sufficient size, the entire workpiece 12 can be illuminated at the same time. This allows a complete image of the shape of workpiece 12 to be captured instead of having a single point light which illuminates only a small area of the workpiece 12 at a given time. A faster and more accurate rendition of the shape of the workpiece 12 is thus generated. Furthermore, because the entire workpiece 12 is illuminated at the same time, the workpiece does not have to be moved in relation to the light source 16 or vice versa but can remain stationary as the image is captured.

The workpiece 12 may be any type of fabric which is at least somewhat transparent or translucent and includes a wide variety of woven and non-woven fabrics ranging from fine silk to heavy denim. By "at least somewhat transparent or translucent" is meant that the fabric will transmit light at a somewhat reduced intensity. This means at least a portion of the light from the illumination source 16 will pass through the fabric. This is in contrast with non-translucent, opaque fabrics such as vinyl, leathers, or rubber which block substantially all, if not all, light from passing through itself.

The intensity of the light passing through workpiece 12 will vary, however, depending on the thickness of the fabric. As noted above, if the intensity of light source 16 is properly selected or adjusted, seam 18, which consists of overlapping fabric pieces, will block substantially more light than a single layer of the same fabric and will appear visually as a dark or black stripe. A seam 18 can be formed in many conventional ways. For example, the seam 18 can be formed by overlapping and sewing together two fabric workpieces, or it can be formed by the same workpiece being folded on itself as in a cuff.

A camera 22 is preferably located above the light table 10 for capturing an image of the light table, including any workpiece 12 placed thereupon. Preferably, camera 22 is a CCD vision system video camera. An image processor 24, coupled to the camera 22, filters the image and converts the image to a digital signal. The processor 24 is preferably coupled to a controller such as computer 26 which can process the image according to instructions contained in a memory 28. Although shown here as two separate items, image processing functions can be performed within the computer 26 thus eliminating the need for a separate image processor 24.

Computer 26 contains, in memory 28, a stored image of the shape of workpiece 12 with a known seam orientation and a known workpiece orientation. The digital signal captured by the camera 22 is processed to determine the orientation of the workpiece 12 from a combination of the workpiece shape and the location of at least one seam 18 in the workpiece 12. Location of the seam is accomplished by locating the area having the lowest intensity of light passing through the workpiece 12. As indicated above, more light is able to pass through a single layer of fabric 20 than through a seam. The processing means distinguishes the differences in light intensity across the light table 10 to determine shape of the workpiece 12 as placed on the light table 10, and the location of the seams. As noted above, those areas which correspond to the seam 18 will appear as a substantially dark or black line across the workpiece 12. After processing, the computer 26 can compare the shape of the workpiece and the location of the seam or seams with a stored image of a sample workpiece having a known and/or desired orientation and one or more "landmark" seams in order to determine whether the orientation of the workpiece 12 on the light table 10 is as desired or whether the workpiece 12 is not correctly oriented (e.g., rotated and/or inverted on the light table). Thus, the present invention is particularly useful for reorienting fabric workpieces which have two different sides (such as, for example, denim fabric which has a dark side and light side) where the fabric workpieces have become inverted during processing, and must be reoriented to produce a marketable garment in which all the sewn parts have the desired side out.

Once the orientation of the workpiece 12 is determined, subsequent automatic reorientation and manipulation of the workpiece 12 is possible and can be performed to enable further operations on the workpiece 12. These operations include but are not limited to, additional sewing, stacking or reorientation of workpieces in a known orientation, for transfer to another work station, or other workpiece manipulations. Furthermore, because the camera 22 is able to capture a complete picture of the workpiece and because the processing unit/computer 26 is able to compare the captured image with a complete stored image, it does not matter how the workpiece is placed on the table 10, as long as it lies flat. In other words, the workpiece can be rotated in either direction, or inverted, from its desired orientation on the table and the processing unit/computer 26 can still determine its orientation.

Figure 2:
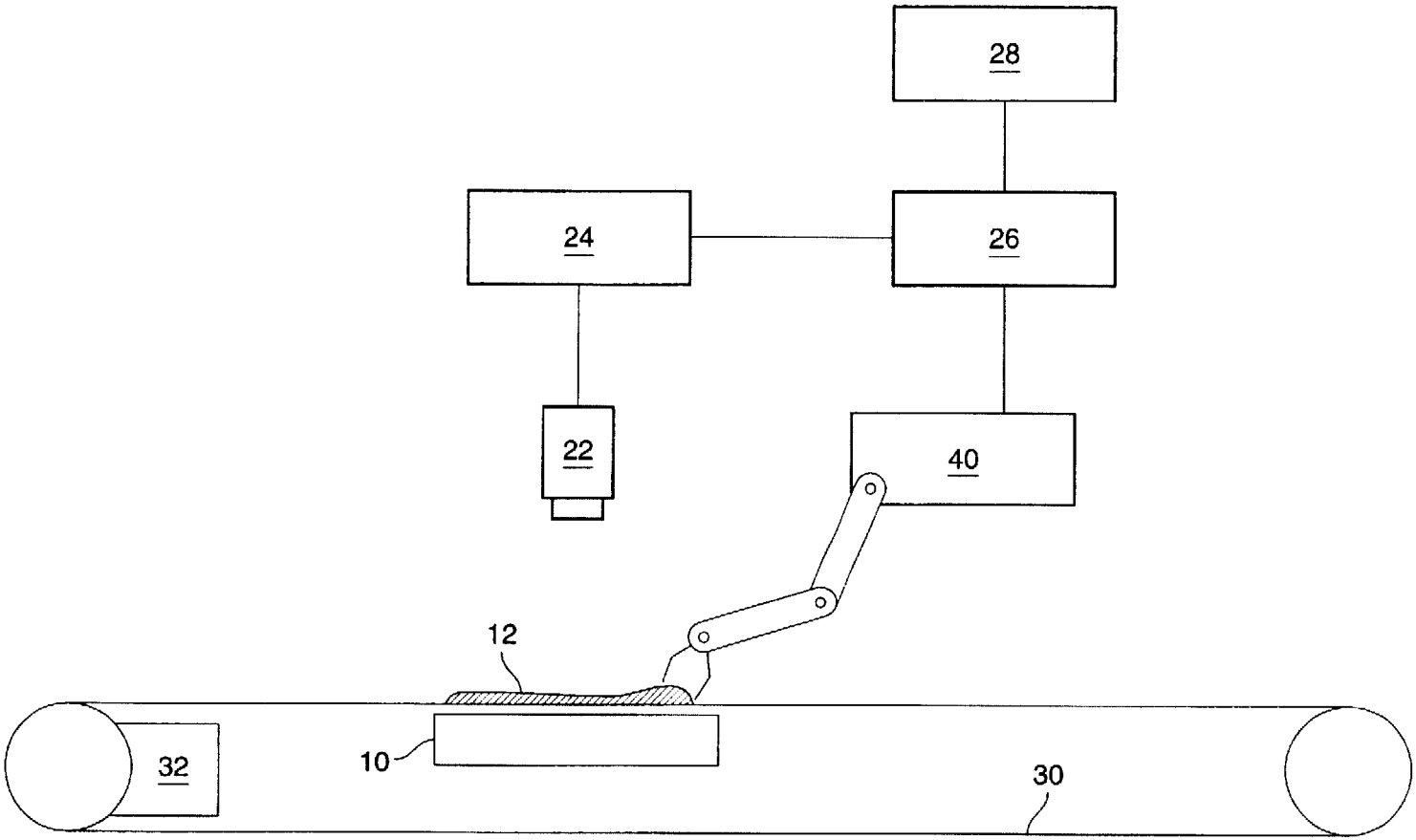
FIG. 2 illustrates an alternate preferred embodiment of the present invention.

As shown in FIGS. 1 and 2, computer 26 can also be in communication with and control a manipulating device 30, such as, for example, an industrial robot or individual hydraulically or pneumatically controlled arms, for removing a workpiece from a stack of like pieces or from a conveyor, for positioning the workpiece on the illuminated surface of light table 10, for reorienting the workpiece on the light table 10 to match the orientation of the stored image, if that orientation is preferred or desired, and for moving the workpiece off the light table 10 after orientation has been determined and/or adjusted.

FIG. 2 illustrates an alternate preferred embodiment of the optical seam locator. Here, all elements are the same as the similarly numbered elements of FIG. 1 with the addition of the conveyor track 30 and the drive assembly 32. The track 30 is positioned to pass a plurality of workpieces 12 over the light table 10. This allows for automatic inspection of numerous workpieces. The conveyor track 30 can be powered by a drive assembly 32 of any well known type and should be transparent or translucent such that the light shining from the light table 10 can pass through to the camera 22. This embodiment allows for the quick determination of the orientation of numerous workpieces 12 in succession. Reorientation, if desired, can be accomplished through the use of a robot controlled by computer 26. Workpiece 12 is stationary when the camera 22 captures an image thereof.

Figure 3:
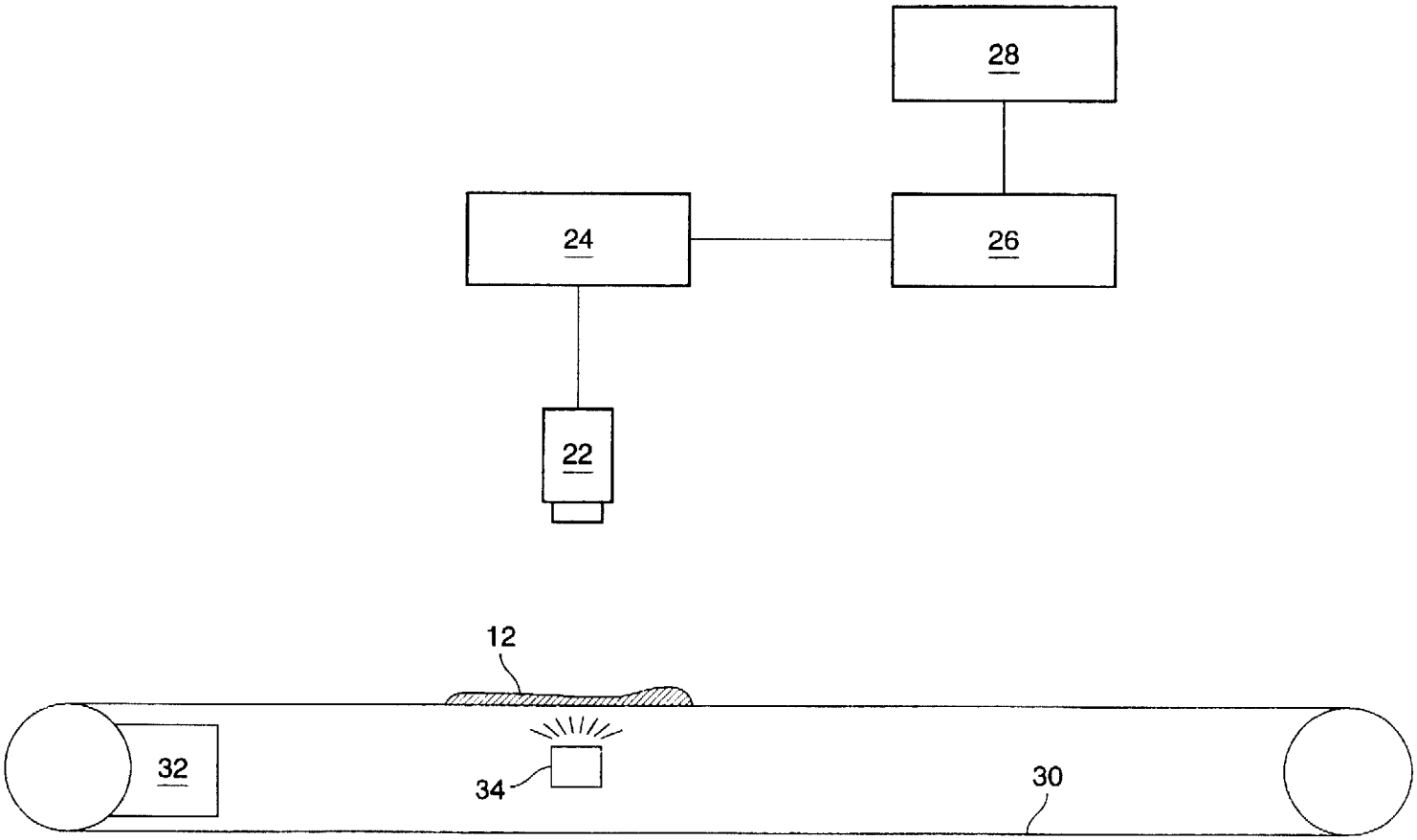
FIG. 3 illustrates an alternate light source for the alternate preferred embodiment shown in FIG. 2.

Alternatively, a light source 34 could be used in conjunction with a transparent or translucent conveyor instead of a light table, as shown in FIG. 3. Because the track 30 is able to support the workpiece 12, and is translucent enough that light can pass through it, a light table such as the one shown in FIG. 2 would not be needed.

The invention has been described in terms of the preferred embodiment. One skilled in the art will recognize that it would be possible to construct the elements of the present invention from a variety of materials and to modify the placement of the components in a variety of ways. While the preferred embodiments have been described in detail and shown in the accompanying drawings, it will be evident that various further modifications are possible without departing from the scope of the invention as set forth in the following claims.

We claim:

1. An apparatus for automatically determining the orientation of a translucent fabric workpiece having at least one seam, comprising:

a transparent or translucent surface having a first side, a second side, and a periphery, said surface being sufficiently large to contain on said first side the entire translucent fabric workpiece in a flat orientation within the periphery of said surface;

a light source for emitting light of a given intensity and mounted adjacent to said second side of said surface for transmitting light through said transparent or translucent surface to yield at said first side light of a first intensity, through said fabric workpiece to yield a second intensity, and through said seam to yield a third intensity, said first intensity being greater than said second intensity, and said second intensity being greater than said third intensity;

a camera means mounted over and aimed at said first side of said surface for capturing an electronic image of the workpiece on the surface as the workpiece is illuminated by said light source; and a computer means coupled to said camera means for:

comparing the electronic image of the workpiece to a stored image of a like workpiece having at least one seam and a known orientation, and determining whether the orientation of the workpiece on the surface is identical to the orientation of the stored image or whether the workpiece on the surface requires reorientation to match the orientation of the stored image.

2. The apparatus of claim 1 additionally comprising a means for adjusting the intensity of the light emitted by the light source to adjust the contrast between said first intensity, said second intensity, and said third intensity.

3. The apparatus of claim 1 wherein said camera means comprises a charge coupled device (CCD) camera.

4. The apparatus of claim 1 wherein said computer comprises:

a. an image processor coupled to said camera means for receiving and processing said electronic image of the workpiece;

b. a memory means coupled to said image processor containing said stored image of a like workpiece having at least one seam and a known orientation; and c. a processing unit coupled to said memory means for comparing the shape and seam location of said workpiece on said surface to that of said stored image to determine orientation.

5. The apparatus of claim 1 wherein said surface is a light table.

6. The apparatus of claim 1 wherein said surface is formed from a light transmitting conveyor surface for supporting a plurality of workpieces individually placed thereon without overlapping, said light transmitting conveyor surface coupled to a drive assembly for moving said conveyor surface.

7. The apparatus of claim 1 additionally including a manipulating means for moving said workpiece onto and off of said surface and for reorienting said workpiece to match the orientation of the stored image, said manipulating means coupled to and controlled by said computer.

8. An optical seam locator for locating a seam formed by overlapping fabrics in a workpiece, comprising:

a light transmitting surface for supporting substantially the entire work piece laid flat on said light transmitting surface;

an illumination means mounted for transmitting sufficient light through said surface for yielding light of a first intensity at said surface, light of a second intensity through the workpiece, and light of a third intensity through the seam, said first intensity being greater than said second intensity, and said second intensity being greater than said third intensity, a camera means for capturing an electronic image of the light transmitted through said surface and the workpiece and distinguishing said first, second and third intensities; and a controller coupled to said camera means for processing said electronic image for locating the seam on the work piece supported on said light transmitting surface, and for determining an orientation of the work piece supported on said light transmitting surface by comparing a location of the seam with a stored image of a sample work piece of known desired orientation.

9. The optical seam locator of claim 8 wherein said controller is a personal computer.

10. The optical seam locator of claim 8 wherein said controller additionally includes memory means for the storage of images of one or more workpieces of known orientation, each said images identifying the location of at least one seam.

11. The optical seam locator of claim 8 wherein said controller determines an orientation of the workpiece from a combination of workpiece shape and seam location.

12. The optical seam locator of claim 8 additionally comprising a means for adjusting the intensity of light transmitted from said light source to enable the adjustment of contrast between said first intensity, said second intensity, and said third intensity.

13. The method of claim 12 wherein the known orientation of the stored image is the desired orientation.

14. The method of claim 13 additionally comprising the step of manipulating the workpiece to change its orientation, and repeating steps a through c until the orientation of the workpiece matches the orientation of the stored image.

15. The optical seam locator according to claim 8 further comprising a conveyer means, said conveyer means comprising:

a light-transmitting track for supporting a plurality of workpieces and translating the workpieces across said surface; and, a drive assembly for moving said track.

16. The optical seam locator according to claim 8 further comprising a manipulation means coupled to and controlled by said controller for moving said workpieces onto and off of said surface and for reorienting said workpiece as instructed by the controller.

17. A method for determining, and adjusting as desired, the orientation of a translucent fabric workpiece containing at least one seam formed by overlapping fabrics, comprising the steps of:

a. illuminating the entire workpiece by transmitting light through and around the fabric workpiece, whereby light of a first intensity is emitted around the fabric workpiece, light of a second intensity is emitted through the fabric workpiece, and light of a third intensity is emitted through the seam, said first intensity being greater than said second intensity, and said second intensity being greater than said third intensity to provide a visual contrast which displays the shape of the workpiece and the location of the seam;

b. capturing an electronic image of the illuminated workpiece via a camera means; and, c. transmitting the electronic image to a computer for processing, whereby the orientation of the workpiece is determined by comparing the actual location of the seam of the workpiece with the location of the seam on a stored image of a like workpiece of known orientation.

18. The method of claim 17 wherein the step of illuminating the entire workpiece is accomplished by placing the workpiece on a light table sufficiently large to illuminate the entire workpiece.

19. The method of claim 17 wherein the camera means used in the step of capturing the image is a CCD camera.

* * * * *